US009375634B2

(12) United States Patent
Kamiyama

(10) Patent No.: US 9,375,634 B2
(45) Date of Patent: Jun. 28, 2016

(54) FUSIBLE BEAD TOY

(75) Inventor: Kei Kamiyama, Shinjuku-ku (JP)

(73) Assignee: EPOCH COMPANY, LTD., Tokyo (JP)

( * ) Notice: Subject to any disclaimer, the term of this patent is extended or adjusted under 35 U.S.C. 154(b) by 728 days.

(21) Appl. No.: 13/454,147

(22) Filed: Apr. 24, 2012

(65) Prior Publication Data

US 2013/0183881 A1 Jul. 18, 2013

(30) Foreign Application Priority Data

Jan. 13, 2012 (JP) ..... 2012-004920

(51) Int. Cl.

| | |
|---|---|
| ***A63H 13/15*** | (2006.01) |
| ***A63F 9/06*** | (2006.01) |
| ***B44C 3/12*** | (2006.01) |
| *A63F 3/00* | (2006.01) |

(52) U.S. Cl.
CPC ... *A63F 9/06* (2013.01); *B44C 3/12* (2013.01); *A63F 2003/00328* (2013.01); *A63F 2003/00794* (2013.01)

(58) Field of Classification Search
USPC ..... 525/56; 446/146, 147
See application file for complete search history.

(56) References Cited

U.S. PATENT DOCUMENTS

| | | | | |
|---|---|---|---|---|
| 5,883,042 | A * | 3/1999 | Defieuw et al. | 503/201 |
| 7,056,651 | B1 * | 6/2006 | Simpson et al. | 430/353 |
| 2002/0102905 | A1 | 8/2002 | Tseng | |
| 2007/0217820 | A1 * | 9/2007 | Shigemori et al. | 399/134 |
| 2008/0011770 | A1 | 1/2008 | Tobias | |

FOREIGN PATENT DOCUMENTS

| | | | |
|---|---|---|---|
| CN | 201052418 | Y | 4/2008 |
| CN | 201201471 | | 3/2009 |
| DE | 19963494 | C1 | 6/2001 |
| EP | 1 847 404 | A2 | 10/2007 |
| JP | 2003-304913 | A | 10/2003 |
| JP | 3131292 | | 4/2007 |
| JP | 2009-125232 | | 6/2009 |
| JP | 2011-139820 | | 7/2011 |

OTHER PUBLICATIONS

Buy Aqua Beads Starter Set at Argos.co.uk [retrieved on Jul. 22, 2013] Retrieved from internet, URL: http://www.argos.co.uk/static/Product/partNumber/3840614.htm, published on Jul. 29, 2010 as per Wayback Machine.

Notification of Reasons for Refusal issued Feb. 25, 2016 in counterpart Japanese Patent Application No. 2012-004920 (2 pages) with an English Translation (3 pages).

* cited by examiner

*Primary Examiner* — Michael Dennis
*Assistant Examiner* — Urszula M Cegielnik
(74) *Attorney, Agent, or Firm* — Drinker Biddle & Reath LLP

(57) ABSTRACT

A fusible bead toy includes a particulate bead. The particulate bead is made of a transparent and water soluble resin. The particulate bead has a shape of polyhedron.

7 Claims, 6 Drawing Sheets

FUSIBLE BEAD TOY

BACKGROUND

1. Field of the Invention

The present invention relates to a fusible bead toy including a fusible bead, which can be enjoyed by allowing small particles called beads to fuse together.

2. Description of Related Art

Today, there are toys which are called bead toys to amuse persons therewith by allowing the beads of small spherical or tubular members made of a resin to fuse together so as to form various kinds of accessories.

In a bead toy described in JP-A-2011-139820, particulate beads or short tube shaped beads having various colors are arranged to contact one another so as to draw a relatively simple picture by the beads, and the adjacent beads fuse together by heat. Accordingly, a flat resin plate having a picture pattern by the beads of the different colors or an accessory having a pattern depending on a form of arrangement of the beads is formed.

Further, the applicant of the present application has proposed a bead toy set and a jig for forming an accessory, in which beads formed by a water soluble resin are arranged to contact one another, water is supplied to the beads to melt the surfaces of the beads, and then, the beads are dried such that the beads fuse together, without heating the beads to fuse. Accordingly, a work such as a flat plate shaped sheet or an accessory having a picture pattern is easily formed (for example, JP-U-3131292 and JP-A-2009-125232).

SUMMARY

According to the above-described bead toy, the beads of various colors are provided, and the accessory having the picture pattern with a lot of colors can be formed.

However, in the bead toy merely including spherical or short tube shaped beads of different colors, when many accessories are formed, if the picture pattern is not designed to change by using many beads, the pattern or the form is similar to those of former articles, thereby lacking in variation. Therefore, the accessory may occasionally have a taste only for the pattern or the form, thereby lacking in interest. Accordingly, when a user enjoys the bead toy for a long time, the user may be occasionally tired of the bead toy.

An object of an aspect of the present invention is to provide a bead toy using novel beads which eliminates the above-described disadvantages and can enjoyably amuse a user for a long period of time without tiresomeness.

According to an aspect of the present invention, a fusible bead toy includes a polyhedral particulate bead made of a transparent and water soluble resin.

BRIEF DESCRIPTION OF THE DRAWINGS

FIGS. 5A to 5G are external views of various examples of shapes of beads of the fusible bead toy according to the embodiment of the present invention.

DETAILED DESCRIPTION

A fusible bead toy according to an embodiment of the present invention includes a polyhedral bead 10 made of a transparent and water soluble resin.

Figure 5A:
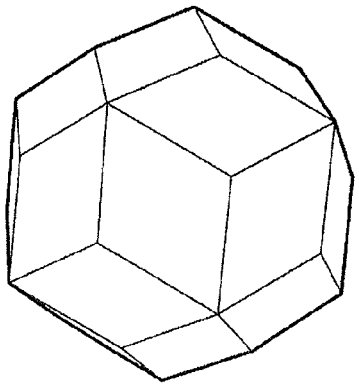

An exemplified polyhedron applied to the bead 10 includes a rhombic triacontahedron, as shown in FIG. 5A.

Figure 1A:
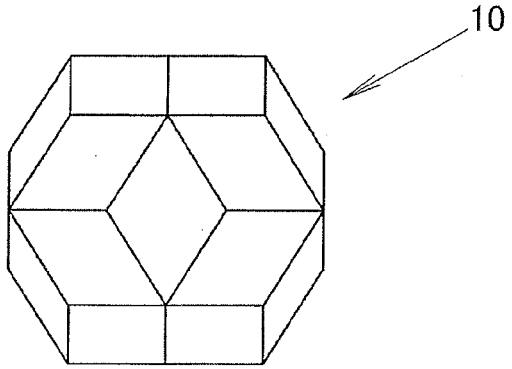
FIGS. 1A to 1C are external views of a bead having a shape of rhombic triacontahedron as one example of a bead of a fusible bead toy according to an embodiment of the present invention, which are viewed from different positions, respectively.
Figure 1B:
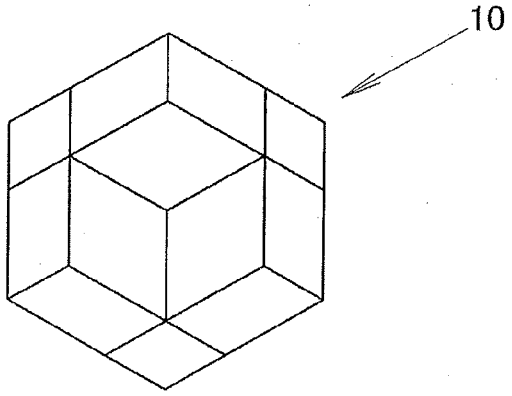
Figure 1C:
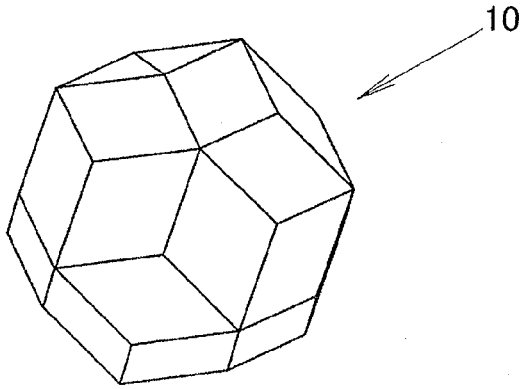

The rhombic triacontahedron is formed by a combination of thirty rhombuses of the same size. As shown in FIGS. 1A to 1C, the shape of faces or outline of the rhombic triacontahedron is different depending on the position of viewpoint.

FIG. 1A shows the bead 10 when viewed from a predetermined position. In FIG. 1A, a center face and four adjacent faces thereof are observed as rhombuses, but other faces are observed as rectangles and irregular rhombuses. FIG. 1B shows the bead 10 when viewed from another position. In FIG. 1B, three center faces are observed as rhombuses, but surrounding faces are observed as shapes similar to rhombus or shapes different from rhombus. FIG. 1C shows the bead 10 when viewed from yet another position. Similarly, the bead 10 shown in FIG. 1C is observed as having various different shapes similar to rhombus.

Figure 2:
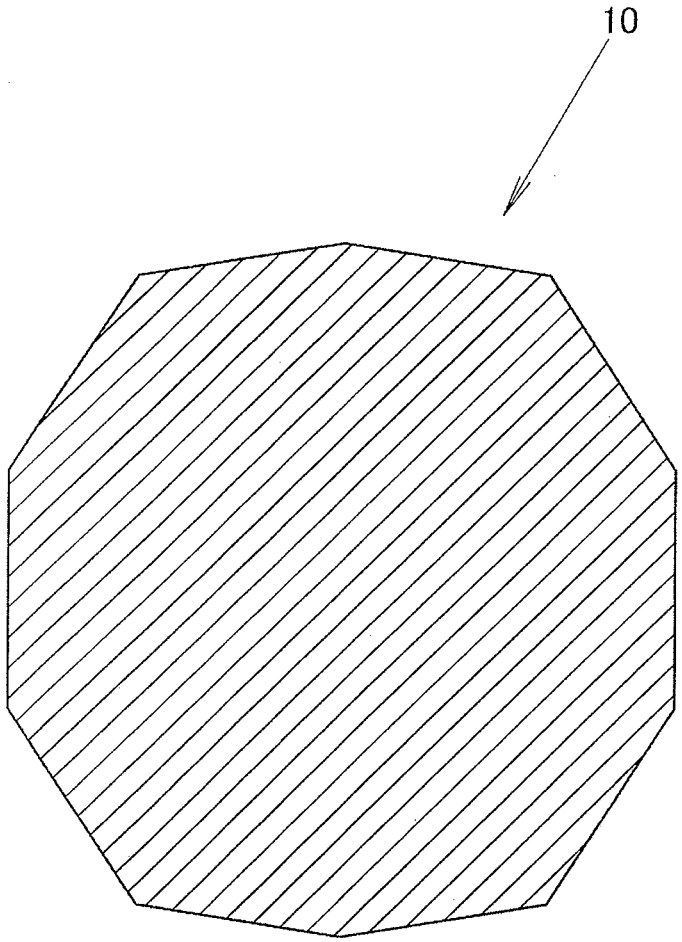
FIG. 2 is a sectional view of the bead having the shape of rhombic triacontahedron as one example of the bead of the fusible bead toy according to the embodiment of the present invention.

As shown in FIG. 2, the rhombic triacontahedron is a convex polyhedron of which interior angles at all vertices are obtuse angles.

The bead 10 of the fusible bead toy has a particle diameter, for example, of 5 mm, similar to the particle diameter of the spherical bead of the bead toy which is commercially available.

The water soluble resin used for the bead 10 is, for example, a synthetic resin containing polyvinyl alcohol.

The color of the bead 10 is, for example, colored transparent. The colored transparent bead 10 can be obtained by coloring the water soluble resin by a coloring agent. The bead 10 is colored, for example, by a color such as green, blue, red, yellow or violet, as a color which harmonizes a transparence with the color. However, the color of the bead 10 is not limited thereto. Further, the bead 10 may be colorless transparent.

As described above, the bead 10 is made of the water soluble resin. Therefore, adjacent beads 10 can fuse together by the following steps (a) to (c). That is, at step (a), the beads 10 are arranged so as to contact each other. At step (b), the surfaces of the beads 10 are made wet and thereby dissolved, by applying liquid such as water to the beads or by immersing the beads in the liquid such as water. At step (c), the beads 10 are dried by evaporating the water.

A brief description of a method for forming the accessory by the beads 10 of the fusible bead toy will be presented below with reference to FIGS. 3 and 4.

Figure 3:
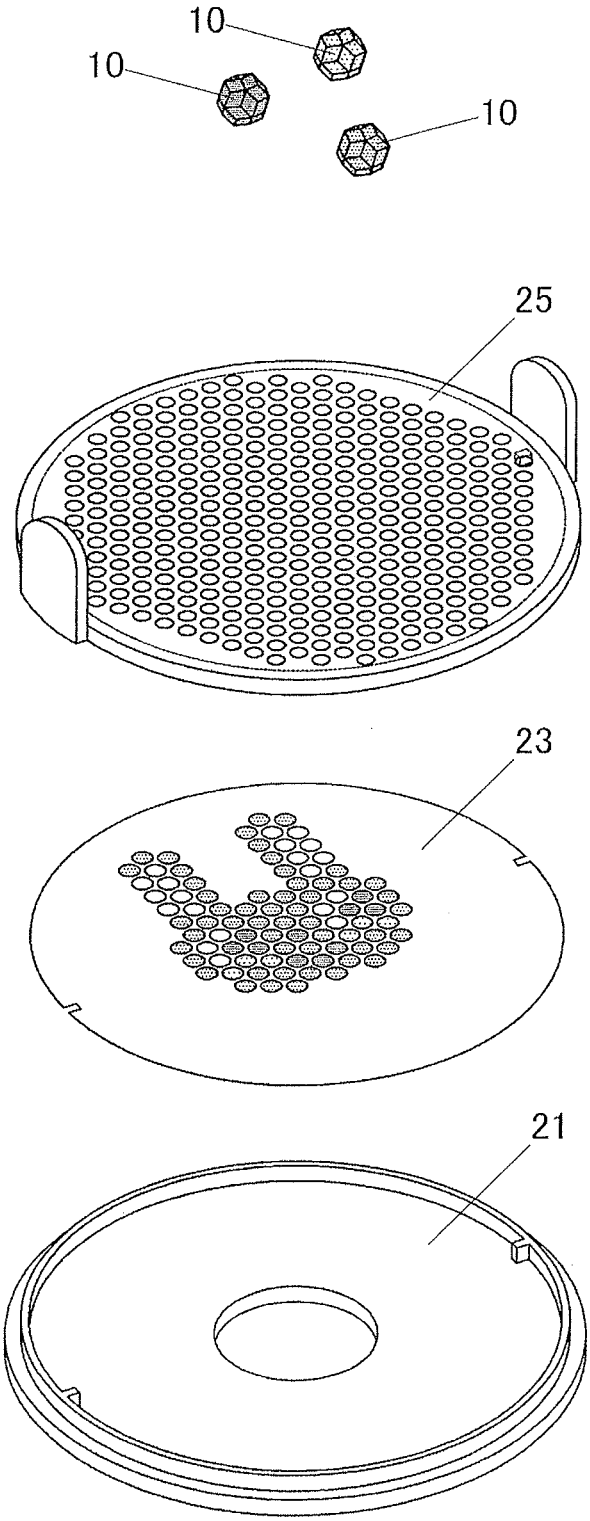
FIG. 3 is a diagram showing one example of a using method of the beads of the fusible bead toy according to the embodiment of the present invention.

As shown in FIG. 3, for forming the accessory 30 by using the beads 10 of the fusible bead toy, a dish shaped base tray 21, an illustration sheet 23 and a transparent plate shaped bead tray 25 are used. The illustration sheet 23 can be fixed to an inner side of the base tray 21 and includes a picture pattern drawn by a beads-shaped spot depiction which has various colors. The bead tray 25 can be fixed to the inner side of the base tray 21.

In FIG. 3, the beads 10 are exaggeratedly shown large as compared with the size of the base tray 21 or the bead tray 25.

Further, the bead tray 25 has dents formed on an upper surface thereof. Each of the dents has a diameter smaller than the particle diameter of the bead 10. The dents are arranged at intervals substantially equal to but slightly smaller than the particle diameters of the beads 10.

Figure 4:
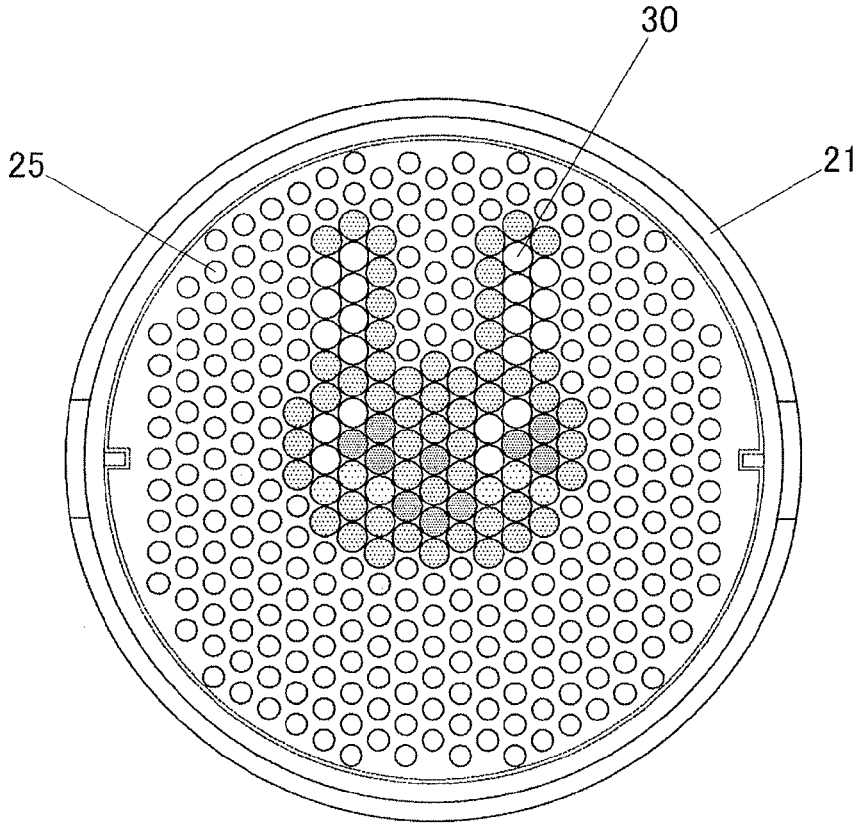
FIG. 4 is a diagram showing one example of a state that the beads of the fusible bead toy according to the embodiment of the present invention are arranged.

As shown in FIG. 4, when the beads 10 are arranged in the adjacent dents of the bead tray 25, the beads 10 are stably placed at positions of the adjacent dents in a state in which the beads contact each other.

The accessory 30 can be formed by the following process. At first, the illustration sheet 23 is fixed to the base tray 21. On the illustration sheet 23, a desired picture pattern is drawn. Next, the bead tray 25 is fixed on the illustration sheet 23. The beads 10 of desired colors are placed on the dents of the bead tray 25 so as to follow the picture pattern drawn on the illustration sheet 23. Thereafter, the water is applied to the beads 10 by a brush or a sprayer so as to wet the beads 10, and the beads 10 are dried. Accordingly, the accessory 30 corresponding to the picture pattern drawn on the illustration sheet 23 is formed.

In FIG. 4, for the sake of simplification, the colored transparent beads 10 of the polyhedron of the rhombic triacontahedron are schematically shown as spherical shapes.

As described above, the bead 10 used for the bead toy of the embodiment has the shape of the polyhedron. Therefore, when the surfaces of the beads 10 contact one another, the adjacent two beads 10 contact each other in the flowing state (i) or (ii). In the state (i), the surface of one of the adjacent beads 10 contacts the surface of the other of the adjacent beads 10. In the state (ii), the vertex or the side of one of the adjacent beads 10 contacts the other of the adjacent beads 10.

When the adjacent beads 10 contact each other in the state (i), the areas in which the adjacent beads 10 contact each other are increased. Thus, the beads 10 are mutually strongly bonded. Consequently, an accessory assembled by the beads 10 is hardly broken.

The liquid such as water is likely to infiltrate into the bead 10 at the vertex or side thereof. Thus, the resin of the bead 10 proceeds to be dissolved and softened in a short time. Consequently, when the adjacent beads 10 contact each other in the state (ii), the vertex or the side of the bead 10 is greatly deformed due to the contact pressure between the beads 10. Consequently, the beads 10 can be strongly bonded together.

That is, the bead 10 is made of water soluble and has the shape of the polyhedron, whereby even when the adjacent two beads 10 are arranged in any one of the states (i) and (ii), the beads 10 can be mutually strongly bonded.

Further, the bead 10 is made of the transparent water soluble resin and has the shape of polyhedron. Therefore, when the accessory 30 is formed using such bead 10, the state of a surface reflected light or a refracted light is changed depending on the angle of illuminating light. Consequently, it is possible to provide the accessory 30 which can allow a user to enjoy, without tiresomeness, the change of brilliance of the accessory 30 in addition to the beauty of the shape of the accessory 30. Further, the bead 10 is colored transparent, whereby it is possible to provide the accessory which can allow the user to enjoy, without tiresomeness, the change of brilliance with different colors of the accessory 30 in addition to the beauty of the arrangement of the beads 10 with different colors.

Further, when the shape of the polyhedron of the bead 10 is rhombic triacontahedron, since the shape is similar to the sphere, the bead 10 can be handled similar to the spherical bead which is commercially available. Further, the beads 10 can strongly fuse together on extremely small faces and show the beautiful brilliance, and the assembled accessory can be enjoyed for a long period of time.

Further, the bead 10 has the particle diameter of 5 mm. That is, the particle diameter of the bead 10 corresponds to the diameter of the spherical bead which is commercially available. Therefore, the bead 10 can be combined with the spherical bead for forming the accessory 30. In this case, it is possible to form the accessory 30 with the change of the brilliance due to the surface reflected light or the refracted light which is added in a part of the picture pattern of a color arrangement formed by the spherical beads due to a surface glossiness.

The particle diameter of the bead 10 is not limited to 5 mm, and may be 3 to 6 mm. When the particle diameter is about 3 mm, the accessory 30 can be formed with a fine picture pattern. When the particle diameter is about 6 mm, a reflection or refraction by the polyhedron can be clearly exhibited.

The polyhedron shape of the bead 10 is not limited to the rhombic triacontahedron and may be a polyhedron which can be handled substantially similar to a spherical body, such as a convex polyhedron.

For example, the polyhedron may be (1) a polyhedron formed by a combination of regular pentagons and/or regular triangles, such as a regular dodecahedron or a regular icosahedron, (2) a polyhedron having 14 faces or 32 faces formed by cutting vertices of a regular polyhedron, (3) a polyhedron having 60 faces or 62 faces, or (4) a dual of the polyhedrons (1)-(3).

Figure 5B:
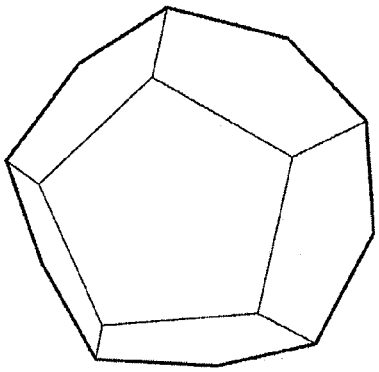
Figure 5A:
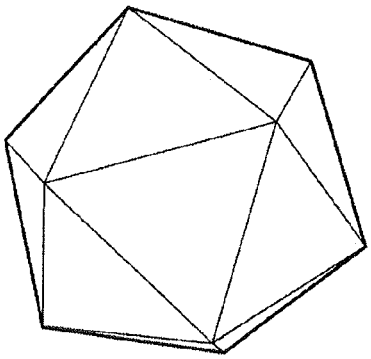
Figure 5D:
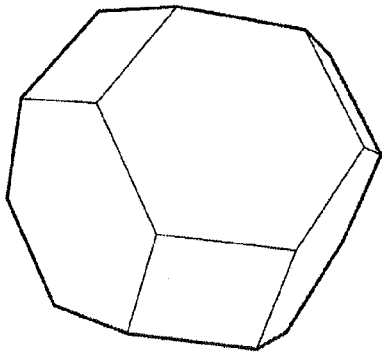
Figure 5E:
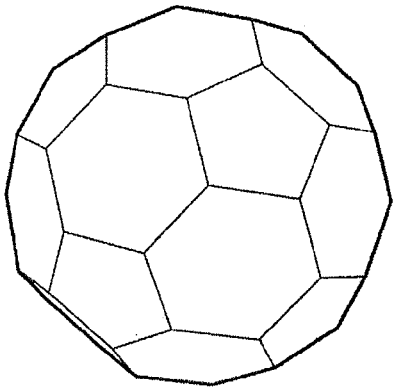
Figure 5F:
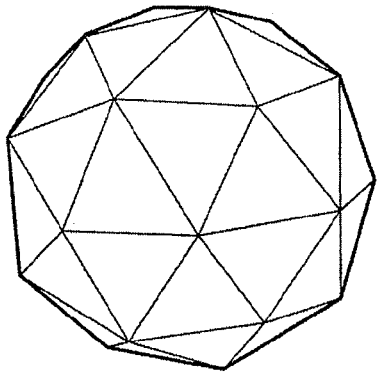
Figure 5G:
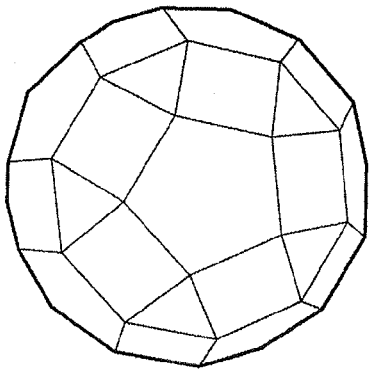

FIG. 5B shows a regular dodecahedron, FIG. 5C shows a regular icosahedron, FIG. 5D shows truncated octahedron as an example of the above-described polyhedron having 14 faces, FIG. 5E shows a truncated icosahedron as an example of the above-described polyhedron having 32 faces, FIG. 5F shows a pentakis dodecahedron as an example of the above-described polyhedron having 60 faces, and FIG. 5G shows a rhombicosidodecahedron as an example of the above-described polyhedron having 62 faces.

If the number of faces of the polyhedron is smaller than 12, the polyhedron is hardly handled like the spherical body. Therefore, beads 10 hardly contact one another and fuse together depending on a direction of the surfaces thereof when the beads 10 are arranged and placed. On the other hand, if the number of the faces of the polyhedron is larger than 62, when the beads 10 has the particle diameters of about 3 mm to 6 mm, the brilliance occurring by the surface reflected light or the refracted light becomes less visible. Therefore, an interest provided by the polyhedron bead decreases, which is undesirable. Consequently, as the polyhedron bead, it is preferable to use the convex polyhedron having 12 to 62 faces.

Further, since the bead toy is enjoyed by combining a plurality of beads as described above, the bead toy can be provided as a set including a plurality of beads 10. According to the set, the accessory 30 can be formed by using a plurality of beads 10. Consequently, it is possible to form the accessory 30 in which the beads 10 can be strongly bonded and which can provide beautiful brilliance.

The set may contain the beads 10 having different colors. According to the set, it is possible to form the accessory 30 showing brilliance with different colors.

Further, the plurality of beads 10 contained in the set may have the polyhedrons of the same shapes and the particle diameters of the same sizes. Thus, when many beads 10 are combined together, the mutually adjacent beads 10 can be easily arranged so as to reliably contact one another.

The above-described embodiment can provide the bead toys according to the following aspects.

A first aspect provides a fusible bead toy including a polyhedral particulate bead made of a transparent and water soluble resin.

With this configuration, the bead provides beautiful brilliance due to a surface reflection on faces or a refracted light. Consequently, the bead can give many changes depending on light applied to an assembled accessory, and a user can be amused with the beads without tiresomeness.

A second aspect provides the fusible bead toy according to the first aspect, wherein the polyhedral particulate bead has a shape of a polyhedron with 12 to 62 faces, which is selected from a group consisting of a regular dodecahedron, a regular icosahedron, and a truncated regular polyhedron obtained by cutting vertices of a regular polyhedron, and a dual thereof.

With this configuration, the bead can be handled substantially similar to a spherical bead and also can show the beautiful brilliance like a diamond cut to amuse the user.

A third aspect provides the fusible bead toy according to the second aspect, wherein the polyhedron is a rhombic triacontahedron.

With this configuration, the beads strongly fuse together on extremely small faces and show the beautiful brilliance, and the assembled accessory can be enjoyed for a long period of time.

A fourth aspect provides the fusible bead toy according to any one of the first to third aspects, wherein a particle diameter of the particulate bead is 3 mm to 6 mm.

With this configuration, it is possible for the user to easily enjoy the bead in combination with the spherical bead which is commercially available.

A fifth aspect provides the fusible bead toy according to any one of the first to fourth aspects, including: a set of a plurality of the particulate beads.

With this configuration, it is possible to form the accessory in which the beads are strongly bonded and which show beautiful brilliance.

A sixth aspect provides the fusible bead toy according to the fifth aspect, wherein the particulate beads are colored transparent, and the set of the particulate beads have different colors.

With this configuration, the accessory providing the brilliance having different colors can be assembled and enjoyed.

A seventh aspect provides the fusible bead toy according to fifth or sixth aspect, wherein the plurality of particulate beads of the set have all a same shape and size.

With this configuration, for all the beads, the adjacent beads arranged at given intervals can easily contact one another, and various kinds of accessories can be easily formed.

The invention has been described in detail with reference to the specific embodiments, but various changes or modifications may be made without departing from the spirit and scope of the invention.

The invention claimed is:

1. A fusible bead toy comprising:

a polyhedral particulate toy bead made of a transparent and water soluble resin, wherein a particle diameter of the particulate bead is 3 mm to 6 mm.

2. The fusible bead toy according to claim 1, wherein the polyhedral particulate bead has a shape of a polyhedron with 12 to 62 faces, which is selected from a group consisting of a regular dodecahedron, a regular icosahedron, and a truncated regular polyhedron obtained by cutting vertices of a regular polyhedron, and a dual thereof.

3. The fusible bead toy according to claim 2, wherein the polyhedron is a rhombic triacontahedron.

4. The fusible bead toy according to claim 1, comprising:

a set of a plurality of the particulate beads.

5. The fusible bead toy according to claim 4, wherein the particulate beads are colored transparent, and the set of the particulate beads have different colors.

6. The fusible bead toy according to claim 4, wherein the plurality of particulate beads of the set have all a same shape and size.

7. A fusible bead toy comprising:

a plurality of polyhedral particulate toy beads made of a transparent and water soluble resin, and a bead tray having dents formed on an upper surface thereof, wherein the dents are arranged at intervals smaller than a particle diameter of the beads such that beads placed at positions of adjacent dents are in a state in which beads contact each other such that when water is applied to the plurality of beads and the beads are allowed to dry, adjacent beads become strongly bonded so that the plurality of beads becomes an assembled structure that maintains its assembled structure when removed from the bead tray, wherein a particle diameter of the plurality of particulate beads is 3 mm to 6 mm.

* * * * *